US007112928B2

(12) United States Patent
Yoo

(10) Patent No.: US 7,112,928 B2
(45) Date of Patent: Sep. 26, 2006

(54) METHOD FOR INCREASING DURABILITY OF ORGANIC LIGHT EMITTING DIODE PANEL

(75) Inventor: Dae-Young Yoo, Chungcheongbuk-do (KR)

(73) Assignee: Magna Chip Semiconductor, Ltd., (KR)

( * ) Notice: Subject to any disclaimer, the term of this patent is extended or adjusted under 35 U.S.C. 154(b) by 70 days.

(21) Appl. No.: 11/072,839

(22) Filed: Mar. 3, 2005

(65) Prior Publication Data

US 2005/0248286 A1 Nov. 10, 2005

(30) Foreign Application Priority Data

May 10, 2004 (KR) ..... 10-2004-0032804

(51) Int. Cl.
*G09G 3/10* (2006.01)

(52) U.S. Cl. ..... 315/169.3; 315/169.2; 345/214; 345/212; 345/39; 345/42

(58) Field of Classification Search .. 315/169.2–169.4; 345/36, 39, 42, 77, 82, 84, 212, 214
See application file for complete search history.

(56) References Cited

U.S. PATENT DOCUMENTS

| | | | | |
|---|---|---|---|---|
| 6,498,592 | B1 * | 12/2002 | Matthies | 345/1.1 |
| 6,710,548 | B1 * | 3/2004 | Kimura | 315/169.3 |
| 2004/0066363 | A1 * | 4/2004 | Yamano et al. | 345/98 |
| 2005/0052446 | A1 * | 3/2005 | Plut | 345/211 |

* cited by examiner

*Primary Examiner*—Haissa Philogene
(74) *Attorney, Agent, or Firm*—Blakely, Sokoloff, Taylor & Zafman

(57) ABSTRACT

An organic light emitting diode (OLED) panel device includes an OLED panel for displaying an image data and an OLED panel operation circuit for outputting the image data to the OLED panel and performing a screen saving operation without a memory access in order to increase a durability of the OLED panel. A method for operating an OLED panel device includes the steps of outputting an image data transmitted from a memory, performing a screen saving operation without a memory access in order to increase a durability of the OLED panel and displaying the image data or the screen saving operation via one of the steps above described.

15 Claims, 7 Drawing Sheets

METHOD FOR INCREASING DURABILITY OF ORGANIC LIGHT EMITTING DIODE PANEL

FIELD OF INVENTION

The present invention relates to an organic light emitting diode operation circuit; and, more particularly, to a method for increasing a durability of an organic light emitting diode panel by using an organic light emitting diode operation circuit for vertically and horizontally scrolling in the organic light emitting diode panel in an effective method.

DESCRIPTION OF PRIOR ART

Generally, a flat panel display (FPD) is classified into two types according to display material: one is an inorganic device and the other is an organic device. The examples of the devices using inorganic materials are a plasma display panel (PDP) which uses a photo luminescence (PL) as fluorescent materials and a field emission display (FED) which uses a cathode luminescence (CE). And the examples of the devices using organic materials are a liquid crystal display (LCD) which is used in various fields and an organic light emitting diode (hereinafter, referred as OLED).

Herein, the OLED has about 30,000 times more rapid response time than the LCD which is the predominant display technology used in today and further, because of OLED's emissive property, the OLED has wide viewing angle and high luminance. These features make OLED technology be desirable as a future display device.

FIG. 1 is a block diagram showing a conventional OLED display.

Referring to FIG. 1, the conventional OLED display includes an OLED panel operation circuit 100, an OLED panel 110 having several unit pixels of matrix form and a memory 120 storing the data to output to the OLED panel 110. When a controller 130 outputs a line address line_addr to the memory 120, the memory 120 outputs a first display data DSP_DATA_1 corresponding with the line address line_addr to the OLED panel 110, and the first display data DSP_DATA_1 is outputted to the unit pixels corresponding with a common address cmm_addr as a second display data DSP_DATA_2. Herein, the common address cmm_addr means a row address of the OLED panel 110 and the line address line_addr means a row address of the memory 120.

Normally in the OLED device, when the first display data DSP_DATA_1 is outputted to the OLED panel 110, the whole pixels of the first display data DSP_DATA_1 are latched to a display latch 140 and, then, outputted to OLED panel 110 at once. Therefore, the OLED panel operation circuit 100 further includes the display latch 140.

FIGS. 2A and 2B are block diagrams showing the operations for the vertical scrolling and horizontal scrolling for increasing a durability of an OLED panel in the conventional OLED panel operation circuit 100.

Referring to FIG. 2A, to vertically scroll an image displayed on the OLED panel 110 (hereinafter, referred as screen) by conventional OLED panel operation circuit 100 as a screen saving operation, it is needed to change a start address start_addr of the line address line_addr in each frame. For example, for using a first display data DSP_DATA_1 in the screen saving operation, if the start address start_addr of the line address line_addr is changed from 00H to 01H and 01H to 02H, and so on, then the screen can be shown as if scrolling in a direction of downside to upside. Herein, for changing a screen, a predetermined line data stored in the memory 120 is continuously accessed by the controller 130.

Referring to FIGS. 2A and 2B, to perform the horizontal scrolling, vertical scrolling or both whenever each frame is displayed, there is no choice but to divide the first display data DSP_DATA_1 in each pixel unit, and then, to transmit the first display data DSP_DATA_1 individually.

However, in order to implement above described process, there is needed considerably large space because of the wiring for data transmission; and it is very difficult to transmit a data for long path through an X-axis (i.e., horizontally) because of the features of the OLED panel operation circuit 100.

If a predetermined pixel in the OLED panel 110 emits light with a constant luminosity continuously, there exists an aging effect that the pixel's life span is decreased. In order to prevent aging phenomenon, while the OLED panel 110 does not display data, the screen on the OLED panel 110 is scrolled horizontally and vertically that the all pixels on the OLED panel 110 can be used evenly.

Although the conventional OLED panel operation circuit 100 is able to perform vertical scrolling, however, to perform horizontal scrolling or to perform both whenever each frame is displayed is still difficult.

SUMMARY OF INVENTION

It is, therefore, an object of the present invention to provide an organic light emitting diode (OLED) panel device for performing a horizontal scrolling, a vertical scrolling and whenever each frame is displayed.

It is another object of the present invention to provide method for increasing durability of an OLED panel with the provided OLED panel device.

In accordance with an aspect of the present invention, there is provided an OLED device including an OLED panel for displaying an image data; an OLED panel operation circuit for outputting the image data to the OLED panel and performing a screen saving operation without a memory access in order to increase a durability of the OLED panel.

In accordance with another aspect of the present invention, there is provided a method for operating an OLED panel device including the steps of outputting an image data transmitted from a memory; performing a screen saving operation without a memory access in order to increase a durability of the OLED panel; and displaying the image data or the screen saving operation via one of the steps above described.

BRIEF DESCRIPTION OF THE DRAWINGS

The above and other objects and features of the present invention will become apparent from the following description of preferred embodiments taken in conjunction with the accompanying drawings, in which.

DETAILED DESCRIPTION OF INVENTION

Hereinafter, an OLED operation circuit in accordance with the present invention will be described in detail referring to the accompanying drawings.

Figure 1:
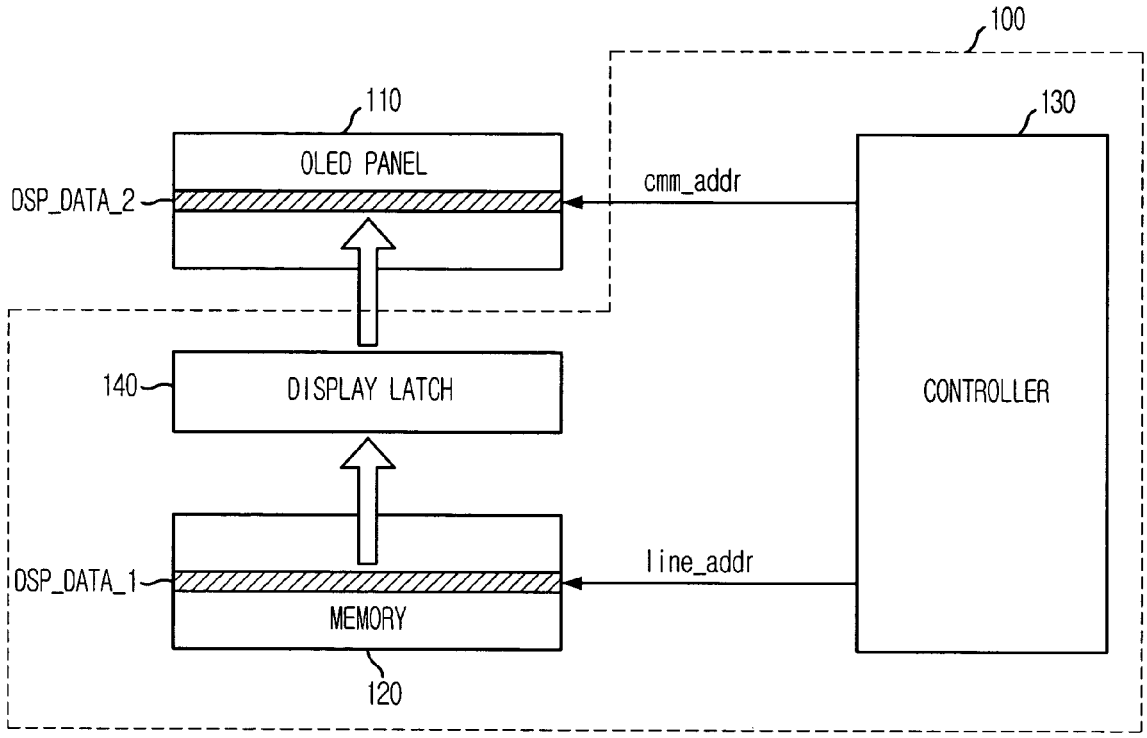
FIG. 1 (PRIOR ART)
FIG. 1 is a block diagram showing a conventional OLED display.
Figure 2B:
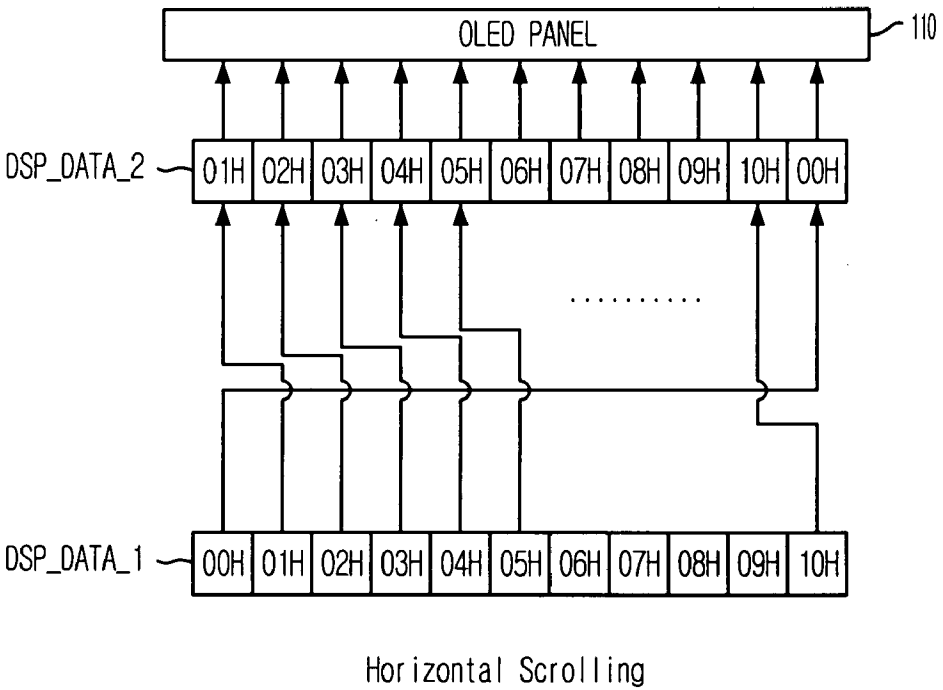
FIG. 2B (PRIOR ART)
FIGS. 2A and 2B are block diagrams showing operations of the vertical scrolling and horizontal scrolling in accordance with the conventional OLED operation circuit.
Figure 2A:
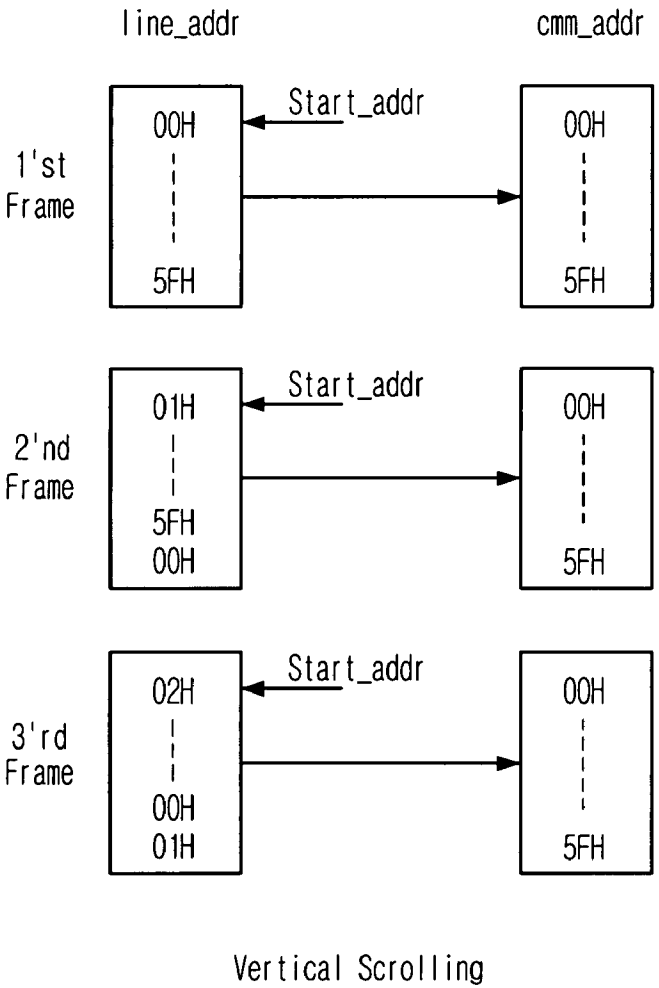
FIG. 2A (PRIOR ART)
Figure 3:
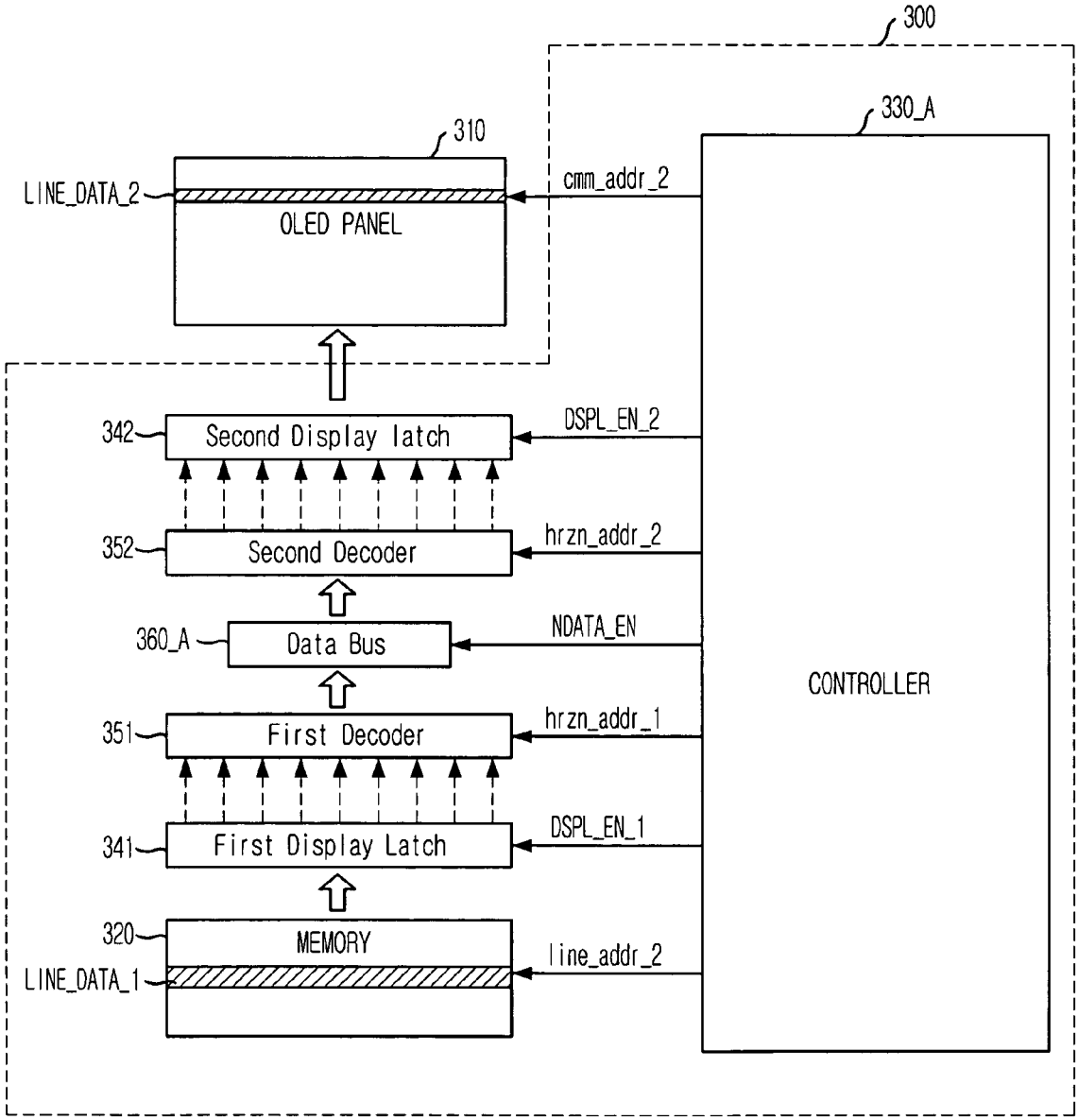
FIG. 3 is a block diagram showing an OLED panel operation circuit in accordance with a preferred embodiment of the present invention.

FIG. 3 is a block diagram showing an OLED panel operation circuit 300 in accordance with a preferred embodiment of the present invention.

Referring to FIG. 3, in order to perform a horizontal scrolling, a vertical scrolling or both as a screen saving operation, the OLED device in accordance with present embodiment includes an OLED panel 310 and an OLED panel operation circuit 300.

Further, the OLED device includes a memory 320 for storing the first line data LINE_DATA_1 which will be display on the OLED panel 310, a first display latch 341 for latching the first line data LINE_DATA_1 transmitted from the memory 320 and a second display latch 342 for latching the fist line data LINE_DATA_1 transmitted in order and, then, outputting to the OLED panel 310.

Also, the OLED device includes a first decoder 351 for decoding the first horizontal address hrzn_addr_1 and, then, transmitting a pixel data latched in the first display latch 341 in response to the first horizontal address hrzn_addr_1; and a second decoder 352 for decoding the second horizontal address hrzn_addr_2 and, then, transmitting the pixel data transmitted from the first decoder 351 to the specified position of the second display latch 342 in response to the second horizontal address hrzn_addr_2.

Further, the OLED panel operation circuit 300 in accordance with the present invention includes a data bus 360_A for transmitting the data outputted from the first decoder 351 to the second decoder 352.

The OLED device further includes a controller 330_A for outputting the first horizontal address hrzn_addr_1 and the second horizontal addresses hrzn_addr_2 and, further outputting a common address cmm_addr_2 to the OLED panel 310, a line address line_addr_2 to the memory 320, a first display latch enable signal DSPL_EN_1 to the first display latch, a second display latch enable signal DSPL_EN_2 to the second display latch, and new data enable signal NDATA_EN to the data bus 360_A for making the data bus transmit a new data.

The OLED panel operation circuit 300 performs the vertical scrolling, horizontal scrolling and both via the two display latches 341 and 342 and the two decoders 351 and 352 in a stacked structure as shown in FIG. 3.

First, the first line data LINE_DATA_1 outputted by the line address line_addr_2 is stored in the first display latch 341. Then, the first decoder 351 sequentially or randomly receives each pixel data once and transmits each pixel data to the data bus 360_A in response to the first horizontal address hrzn_addr_1. Then, the first decoder 351 outputs one pixel data chosen from the first line data LINE_DATA_1 to the data bus 360_A according to the first horizontal address hrzn_addr 1 outputted from the controller 330_A.

In the same time, the second horizontal address hrzn_addr_2 is outputted from the controller 330_A and inputted to the second decoder 352, in order to determine a position of the second display latch 342 where the data outputted through the data bus 360_A will be written.

Finally, through the above process, each pixel data outputted from the first display latch 341 is latched to the second display latch 342 through a path determined by the first and second horizontal addresses hrzn_addr_1 and hrzn_addr_2. After completing transmissions for each pixel data, the second display latch 342 latches a second line data LINE_DATA_2 which is scrolled horizontally.

As above described, the first decoder 351 is for receiving each pixel data outputted from the first display latch 341 and decoding the first horizontal address hrzn_addr_1 to thereby transmit a pixel data outputted from the first display latch 341 to the data bus 360_A. The second decoder 352 is for receiving transmitted pixel data from the data bus 360_A and decoding the second horizontal address hrzn_addr_2 to thereby determine a position of the second display latch 342 where the data transmitted from the second decoder 352 will be latched. Further, the data bus 360_A provides the path for each pixel data to transmit from the first decoder 351 to the second decoder 352.

After the second line data LINE_DATA_2 is latched in the second display latch 342, the data is outputted to the OLED panel 310. Herein, the common address cmm_addr_2 is inputted to the OLED panel 310, and each row line of the OLED panel 310 for displaying the second line data LINE_DATA_2 outputted from the second display latch 342 will be determined.

In order to scroll a pixel data horizontally in the OLED device according to the present invention, the pixel data latched in left most side of the first display latch 341 is latched to the right most side of the second display latch 342, and the rest of data latched in the first display latch 341 is individually moved left side or right side and latched to the second display latch 342. As a result, a horizontally scrolled data can be outputted to the OLED panel 310.

Because the OLED panel operation circuit 300 in accordance with the present embodiment includes the two display latches 341 and 342 and the two decoders 351 and 352 in a stacked structure, it is easy to perform the horizontal scrolling, vertical scrolling and both.

Figure 4:
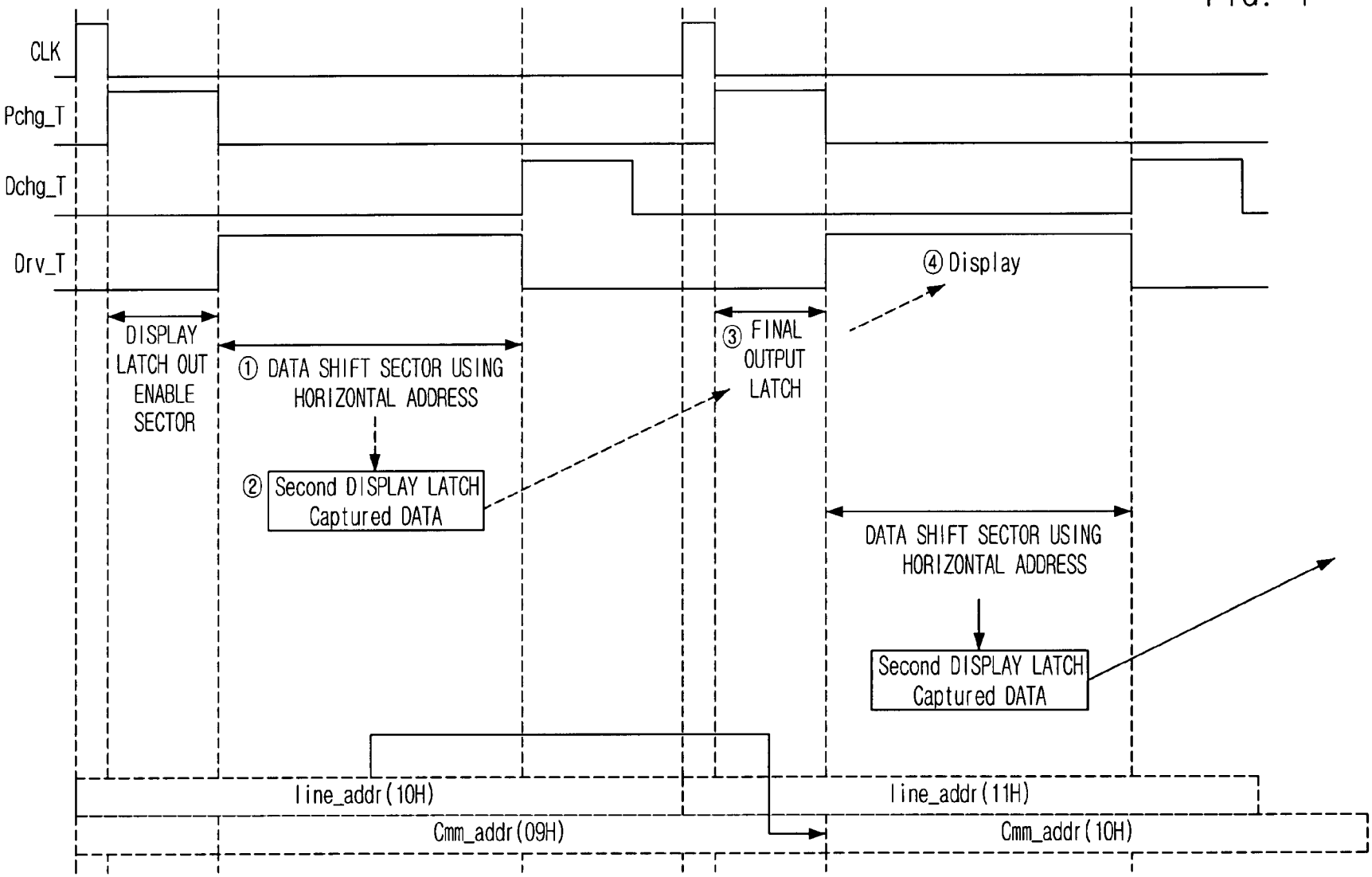
FIG. 4 is a timing diagram showing the operation of the OLED panel operation circuit shown in FIG. 3.
Figure 5:
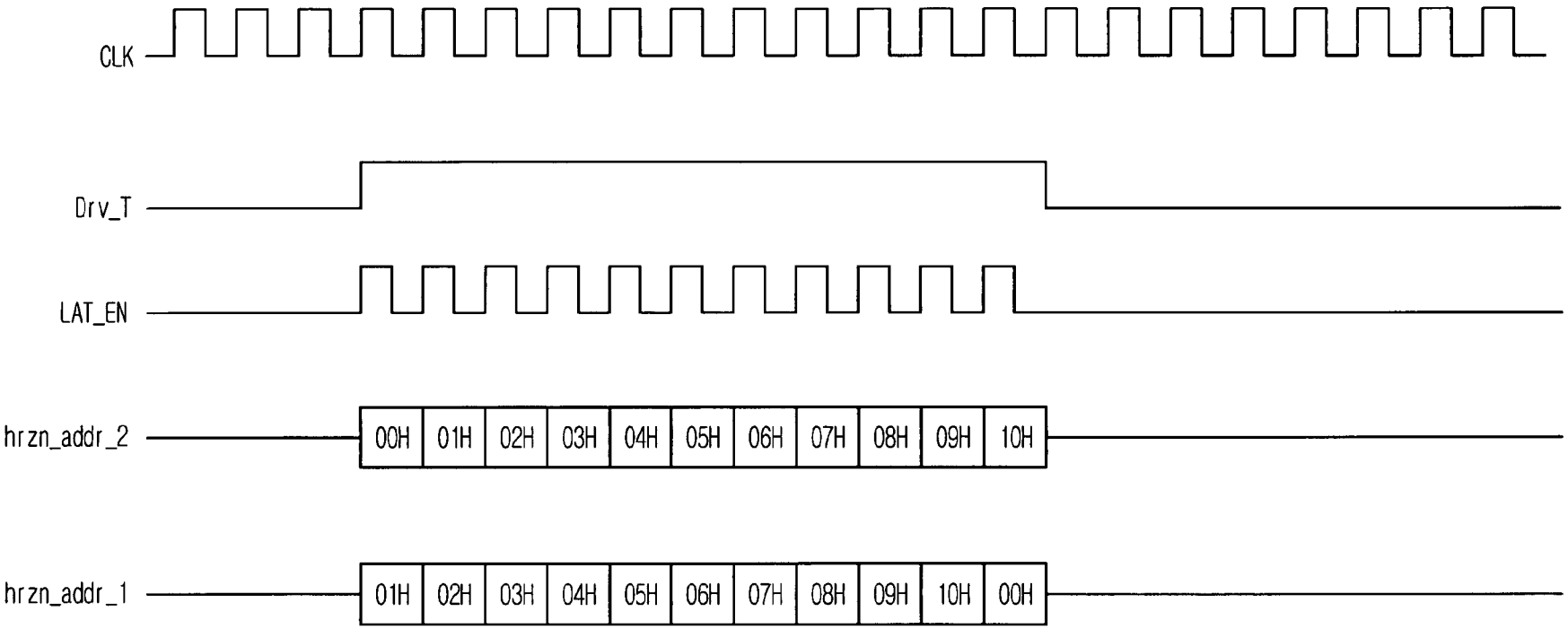
FIG. 5 is a detailed timing diagram showing a driving time shown in FIG. 4.

FIG. 4 is a timing diagram showing the operation of the OLED panel operation circuit 300 shown in FIG. 3, and FIG. 5 is a detailed timing diagram showing a driving time Drv_T shown in FIG. 4. Particularly, FIG. 4 shows a progress of the vertical scrolling, and FIG. 5 shows a progress of the horizontal scrolling.

Referring to FIG. 4, in an internal operation of the OLED panel 310, there are a precharge time Pchg_T, the driving time Drv_T and a discharge time Dchg_T. In order to output the second line data LINE_DATA_2 on the OLED panel 310 as above described, it has to be done during the driving time Drv_T sector to update the second display latch 342 with the following second line data LINE_DATA_2 which will be displayed. Because the driving time Drv_T sector occupies the largest portion of the OLED driving operation and it is possible to scroll the data with the low frequency of the internal display oscillator, we can have operational advantage through using the driving time Drv_T.

At first, a first line data LINE_DATA_1 is latched from the memory 320 to the first display latch 341 and, then, retransmitted from the first display latch 341 to the second display latch 342 by passing through the fist decoder 351 and the second decoder 352 and the data bus 360_A.

Herein, the process of retransmitting the first line data LINE_DATA_1 from the first display latch 341 to the second display latch 342 is accomplished by transmitting a pixel data once as aforementioned.

After finishing above process, the final output is outputted from the second display latch 342 to the OLED panel 310 during following precharge time Pchg_T. Then, the data rearranged and latched in the second display latch 342 is outputted to the OLED panel 310 during following driving time Drv_T.

Herein, the line address line_addr_2 of the data, which stored in the second display latch 342 during the vertical scrolling is performed, is always maintained the next value comparing to the common address cmm_addr_2; i.e., if the common address cmm_addr_2 is 10H and its corresponding OLED pixels is, displaying to the OLED panel 310, then the second display latch 342 is latching the data of following common address cmm_addr_2 11H at that moment.

Further, to operate the horizontal scrolling with vertical scrolling as the screen saving operation, the difference between the line address line_addr_2 and the common address cmm_addr_2 becomes greater.

Because the OLED panel operation circuit 300 in accordance with the present embodiment includes two display latches, i.e., the first display latch 341 and the second display latch 342, the performing of both horizontal and vertical scrollings at each frame is feasible by adding the process for generating a next line address for horizontal scrolling.

The horizontal scrolling also can determine the direction of scrolling through designing and using the second display latch 342 as a counter looping with a predetermined period and the first display latch 341 as a counter increasing or decreasing the start address. With above described processes, a direction of horizontal scrolling can be determined.

While the screen saving operation scrolling is proceeding, the direct access to the memory 320 doesn't occur. Therefore, without any collision with the memory 320 the read/write access to the memory 320 for performing other operations is possible while the scrolling is proceeding.

Referring to FIG. 5, when operating the display latch with the internal oscillator frequency, it is needed to count the number of a clock CLK and to generate a latch enable LAT_EN as much as needed. Then, the first horizontal address hrzn_addr_1 and the second horizontal address hrzn_addr_2 are synchronized with the latch enable LAT_EN and outputted during the driving time Drv_T. During the precharge time Pchg_T and discharge time Dchg_T, the first horizontal address hrzn_addr_1 and the second horizontal addresses hrzn_addr_2, in which the first decoder 351 and the second decoder 352 don't operate, maintain a reset state.

Because the OLED panel operation circuit 300 in accordance with the present invention includes the two display latches 341 and 342 and the two decoders 351 and 352 in a stacked structure and data bus 360_A, a method for increasing durability of the OLED panel by preventing a specific pixel of the OLED panel from being used excessively can be implemented without continuous access to the data of the memory 320.

There provide two method for increasing durability of the OLED panel; one is a method for fading in/out a single screen, and the other is a moving block showing as if an image on the OLED panel are moving.

Figure 6:
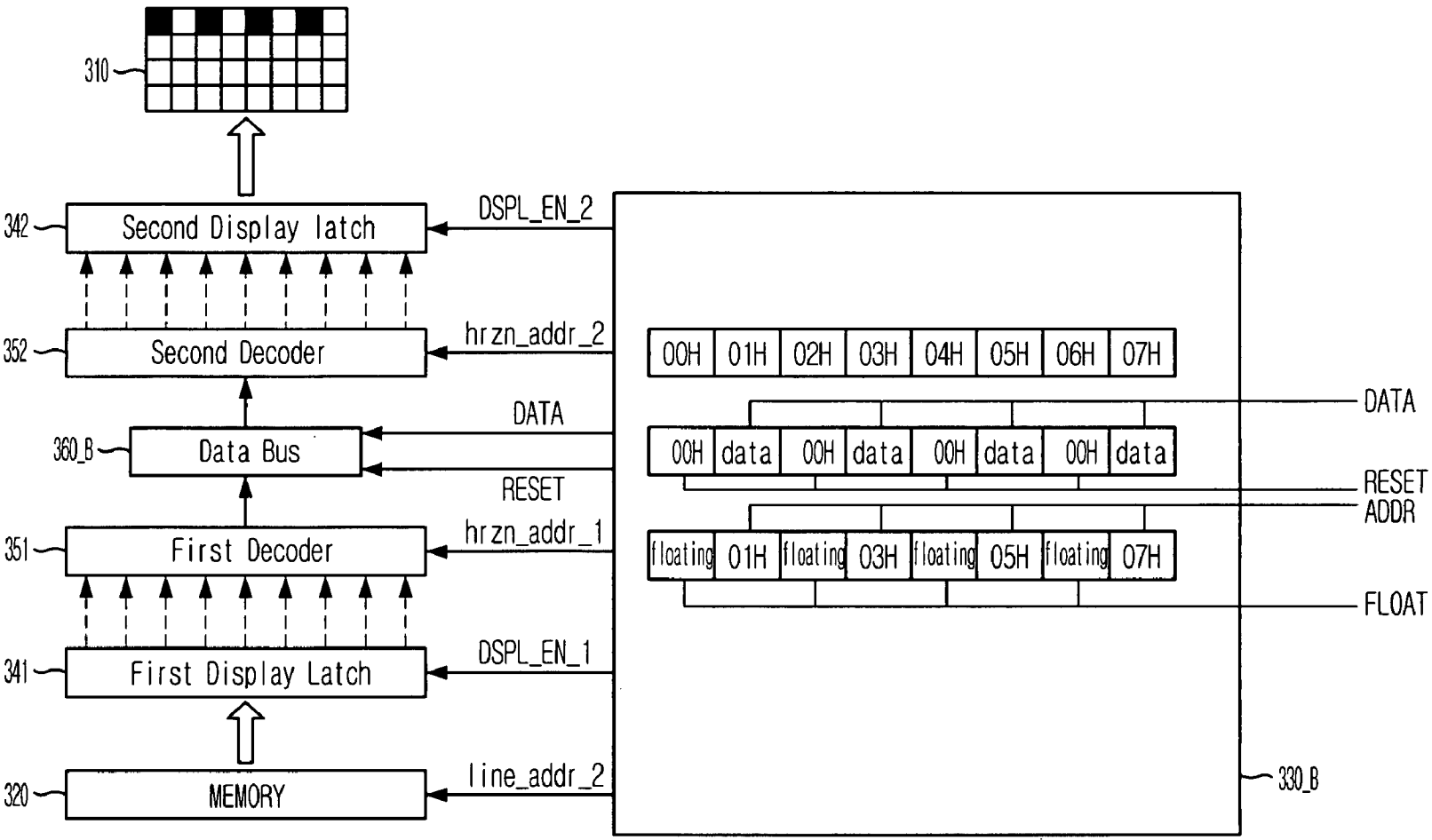
FIG. 6 is a block diagram showing a first method for increasing durability of the OLED panel using the OLED operation circuit shown in FIG. 3.

FIG. 6 is a block diagram showing the fading in/out method using the OLED panel operation circuit 300 shown in FIG. 3, i.e., FIG. 6 is showing a method for using the two display latches 341 and 342 and the two decoders 351 and 352 in a stacked structure which is the core entity of the present invention and fading in/out the screen.

In order to display the black dots by turns on the OLED panel 310 as shown in FIG. 6, (herein, the black dot means the status of turning off the pixel on the OLED panel) the controller 330_B outputs a floating signal FLOAT and an address signal ADDR alternately to the first decoder 351; and, then, the first decoder 351 decides the following action according to the received signal. The first decoder 351 is floated and not outputs any data in response to the floating signal FLOAT; and in response to the address signal ADDR the first decoder 351 transmits a pixel data corresponding to the address signal ADDR from the fist display latch 341 to the data bus 360_B.

Then, the controller 330_B outputs a reset signal RESET and a data signal DATA. The data bus 360_B outputs a ground voltage in response to the reset signal RESET and a pixel data from the first decoder 351 in response to the data signal DATA into the second decoder 352. The pixel data outputted from the data bus 360_B is transmitted to the second decoder 352.

Subsequently, the data transmitted from the second decoder is outputted to the second display latch 342 and outputted to the OLED panel 310 and displayed. According to the various combinations of the reset signals and the data signals, the content displayed on the OLED panel 310 is changed.

The data bus 360_B transmits the data stored in the memory 320 to the OLED panel 310 in response to the control signals outputted from the controller 330_B, i.e., to turn off a specific pixel on the OLED panel 310, the controller 330_B sends the reset signal RESET to the data bus 360_B, and to transmit the data from the memory to the OLED panel 310, the controller 330_B sends the data signal DATA to the data bus 360_B.

By using above processes, an implementation of the fade in/out function can be achieved. To implement a fade out function, first, one pixel of the OLED panel 310 is reset, i.e., turned off. Then, in the next frames the number of reset pixels is gradually increased. In the same manner, to implement a fade in function, pixels on the OLED panel are gradually turned on by transmitting the data from the memory 320 one by one.

Furthermore, the data signal DATA outputted from the controller 330_B can be used instead of the pixel data outputted from the first decoder 351. If a level of the data signal DATA is adjusted, the OLED panel operation circuit 300 according to the present invention can perform more various screen saving operation, e.g., flickering effect.

Figure 7:
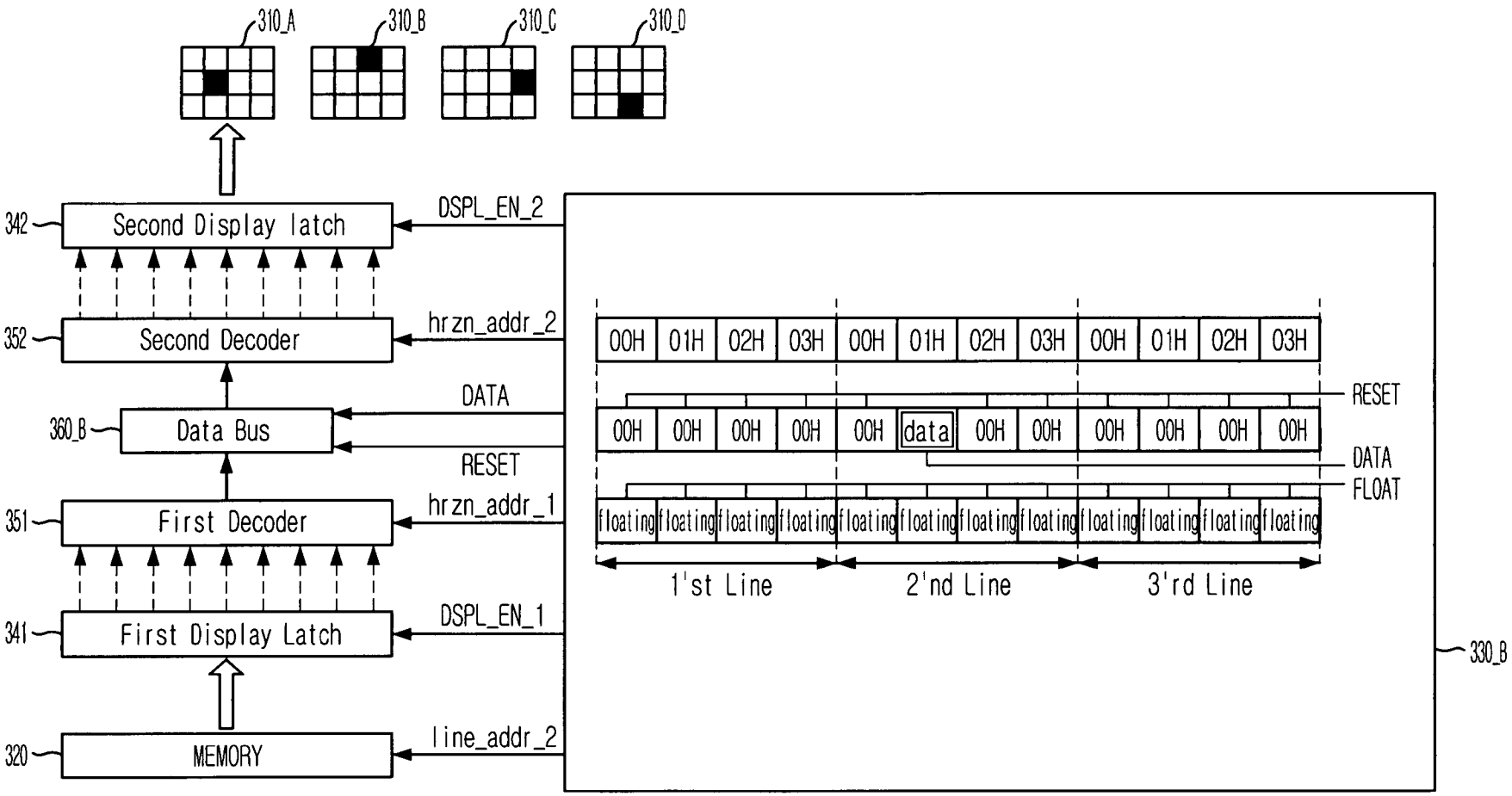
FIG. 7 is a block diagram showing the second method for increasing durability of the OLED panel using the OLED operation circuit shown in FIG. 3.

FIG. 7 is a block diagram showing the method for increasing durability of the OLED panel 310 using the OLED panel operation circuit 300 shown in FIG. 3 and explains the method using the moving block.

Referring to FIG. 7, the operation of the OLED panel operation circuit 300 selects the desired part of an image. Then, the selected part of the image is displayed on the OLED panel 310 and scrolled automatically. When the image reaches the boundary of the OLED panel 310, the image is scrolled in another direction similar to a motion of a billiard ball.

The implementation method for the above function is as follows: first, enabling both horizontal and vertical scroll function, determine the random line address line_addr_2 and the first horizontal address hrzn_addr_1; secondly, make the determined line address line_addr_2 increase or decrease and scroll in vertical direction, in the same time, make the first horizontal address hrzn_addr_1 increase or decrease and scroll in horizontal direction, herein, if the line address line_addr increases almost to point the boundary of the OLED panel 310, then make the line address line_addr decrease, in the same time, if the first horizontal address hrzn_addr_1 increases almost to point the boundary of the OLED panel 310, then make the first horizontal address hrzn_addr_1 decrease, and thus, if a dot on the screen moves in diagonal direction and touches the boundary of the OLED panel 310, then the dot image jumps out similar to a motion of a billiard ball.

The address in the controller 330_B shown in FIG. 7 is showing a left most OLED panel 310_A displaying state; the first line is reset state, the second address of the second line has data, and the third line is also reset state.

Herein, to perform the moving block function, the data access to the memory 320 doesn't happen. Therefore, the controller 330_B stops transmitting the data from the memory 320 to the first decoder 351 by floating the first decoder 351, and controls the data arrangement of the data bus 360_B, i.e., the controller 330_B resets the entire lines of the data bus 360_B by connecting them with a ground voltage except the lines displayed with the data.

Then, the data is transmitted from the data bus 360_B to the second decoder 352. For example, in the case of the second line of the OLED panel 310 in FIG. 7, the one data and the rest with reset states are outputted.

In order to display the data to a desired point in the OLED panel 310 and, the common address cmm_addr_2 and the second horizontal address hrzn_addr_2 are increased or decreased.

In order to show the only selected part of the image, in the case of the moving block, the entire data of the address except the line address line_addr_2 and the first horizontal address hrzn_addr_1 pointing the selected image are reset.

Above two methods for the increasing durability of the OLED panel 310 can be implemented without updating the memory 320 and therefore, provide the advantage to decrease an electric current generated during the operation.

As mentioned above, the OLED panel operation circuit 300 in accordance with the present embodiment can perform the horizontal scrolling, vertical scrolling and both using two display latches 341 and 342 and two decoders 351 and 352. Further, including two display latches 341 and 342, the implementation of various operations to increase durability of the OLED panel (horizontal scrolling, vertical scrolling, horizontal/vertical scrolling, fadein/fadeout scrolling, moving block) can be achieved without the data accessing to the memory 320.

The present application contains subject matter related to Korean patent application No. 2004-32804, filed in the Korean Patent Office on May 10, 2004, the entire contents of which being incorporated herein by reference.

While the present invention has been described with respect to the particular embodiments, it will be apparent to those skilled in the art that various changes and modifications may be made without departing from the spirit and scope of the invention as defined in the following claims.

What is claimed is:

1. An organic light emitting diode (OLED) panel device comprising:

an OLED panel for displaying an image data; and an OLED panel operation circuit for outputting the image data to the OLED panel and performing a screen saving operation without a memory access in order to increase a durability of the OLED panel.

2. The OLED panel device as recited in claim 1, wherein the OLED panel operation circuit includes:

a memory for storing the image data constituted with plural line data;

a first display latch for latching a first line data transmitted from the memory;

a second display latch for latching a second line data to thereby output the second line data to the OLED panel;

a first decoding means for decoding a first horizontal address to thereby transmit each pixel data of the first line data latched in the first display latch;

a second decoding means for decoding a second horizontal address to thereby transmit each pixel data transmitted from the first decoding means to a predetermined position of the second display latch as the second line data; and a controller for generating the first horizontal address including a floating signal for preventing a transmission of a pixel data and a pixel address signal for transmitting a pixel data and the second horizontal address.

3. The OLED panel device as recited in claim 2, wherein the controller generates enable signals each for enabling controls the enables of the first and the second latches.

4. The OLED panel device as recited in claim 2, wherein the OLED panel operation circuit further includes a data bus for transmitting the pixel data outputted from the first decoder to the second decoder and.

5. The OLED panel device as recited in claim 2, wherein the controller further generates control signals including a reset signal for outputting a ground voltage and a data signal for transmitting each pixel data in case when the pixel data is transmitted and for replacing the pixel data in case when the pixel data is not transmitted.

6. A method for operating an organic light emitting diode (OLED) panel device comprising the steps of:

(a) outputting an image data transmitted from a memory;

(b) performing a screen saving operation without a memory access in order to increase a durability of the OLED panel; and (c) displaying the image data or the screen saving operation via one of the step (a) and the step (b).

7. The method as recited in claim 6, wherein the step (a) includes:

(a1) latching a first line data transmitted from the memory;

(a2) decoding a first horizontal address to thereby transmit each pixel data of the first line data; and (a3) decoding a second horizontal address to thereby latch each transmitted pixel data to a predetermined position of a second display latch as the image data.

8. The method as recited in claim 6, wherein the step (b) includes:

(b1) decoding a first horizontal address to thereby transmit each pixel data of a first line data latched in a first display latch;

(b2) transmitting each pixel data of the first line data to a second display latch in response to control signals outputted from a controller; and (b3) decoding a second horizontal address to thereby latch each transmitted pixel data to a predetermined position of a second display latch.

9. The method as recited in claim 8, wherein the first horizontal address includes a floating signal and a pixel address signal.

10. The method as recited in claim 9, wherein the floating signal is for preventing a transmission of a pixel data.

11. The method as recited in claim 9, wherein the address signal is for transmitting a pixel data.

12. The method as recited in claim 8, wherein the control signals includes a reset signal and a data signal.

13. The method as recited in claim 12, wherein the reset signal is for outputting a ground voltage.

14. The method as recited in claim 12, wherein in the case when a pixel data is transmitted, the data signal is for transmitting the pixel data.

15. The method as recited in claim 12, wherein in the case when a pixel data is not transmitted, the data signal is for replacing the pixel data.

* * * * *